US007972196B2

(12) United States Patent
Tanikella et al.

(10) Patent No.: US 7,972,196 B2
(45) Date of Patent: Jul. 5, 2011

(54) METHODS OF CRYSTALLOGRAPHICALLY REORIENTING SINGLE CRYSTAL BODIES

(75) Inventors: Brahmanandam V. Tanikella, Northboro, MA (US); Christopher Arcona, Rutland, MA (US); David I. Gindhart, Battle Ground, WA (US); Christopher D. Jones, Amherst, NH (US); Matthew A. Simpson, Sudbury, MA (US)

(73) Assignee: Saint-Gobain Ceramics & Plastics, Inc., Worcester, MA (US)

( * ) Notice: Subject to any disclaimer, the term of this patent is extended or adjusted under 35 U.S.C. 154(b) by 407 days.

(21) Appl. No.: 12/145,901

(22) Filed: Jun. 25, 2008

(65) Prior Publication Data

US 2008/0318496 A1 Dec. 25, 2008

Related U.S. Application Data

(60) Provisional application No. 60/946,104, filed on Jun. 25, 2007, provisional application No. 60/974,008, filed on Sep. 20, 2007.

(51) Int. Cl.
*B24B 49/00* (2006.01)

(52) U.S. Cl. ..... 451/8; 451/11; 451/278

(58) Field of Classification Search ..... 451/8, 11, 451/41, 278, 279
See application file for complete search history.

(56) References Cited

U.S. PATENT DOCUMENTS

| | | | | |
|---|---|---|---|---|
| 3,123,953 | A * | 3/1964 | Merkl | 451/41 |
| 3,562,965 | A * | 2/1971 | Lang | 451/41 |
| 3,805,458 | A * | 4/1974 | Miller | 451/41 |
| 5,529,051 | A | 6/1996 | Miller | |
| 2005/0103995 | A1 * | 5/2005 | Yanagiuchi et al. | 250/309 |

FOREIGN PATENT DOCUMENTS

| | | | |
|---|---|---|---|
| DE | 254103 | A3 | 2/1988 |
| EP | 0962284 | A | 12/1999 |
| WO | 02100619 | | 12/2002 |

* cited by examiner

*Primary Examiner* — Maurina Rachuba
(74) *Attorney, Agent, or Firm* — Abel Law Group, LLP

(57) ABSTRACT

A method of changing the crystallographic orientation of a single crystal body is disclosed that includes the steps of characterizing a crystallographic orientation of the single crystal body and calculating a misorientation angle between a select crystallographic direction of the single crystal body and a projection of the crystallographic direction along a plane of a first exterior major surface of the single crystal body. The method further includes removing material from at least a portion of the first exterior major surface to change the misorientation angle.

20 Claims, 13 Drawing Sheets

METHODS OF CRYSTALLOGRAPHICALLY REORIENTING SINGLE CRYSTAL BODIES

CROSS-REFERENCE TO RELATED APPLICATION(S)

The present application claims priority from U.S. Provisional Patent Application No. 60/946,104, filed Jun. 25, 2007, entitled "Methods Of Crystallographically Reorienting Single Crystal Bodies," naming inventors Brahmanandam V. Tanikella, Christopher Arcona, David Gindhart, Christopher D. Jones, and Matthew A. Simpson, and U.S. Provisional Patent Application No. 60/974,008, filed Sep. 20, 2007, entitled "Methods Of Crystallographically Reorienting Single Crystal Bodies," naming inventors Brahmanandam V. Tanikella, Christopher Arcona, David Gindhart, Christopher D. Jones, and Matthew A. Simpson, of which both applications are incorporated by reference herein in their entirety.

BACKGROUND

1. Field of the Disclosure

The present application is generally directed to single crystal substrates and methods of finishing such substrates.

2. Description of the Related Art

Semiconducting components based on single crystal nitride materials of Group-III and Group-V elements are ideal for devices such as light-emitting diodes (LED), laser diodes (LD), displays, transistors and detectors. In particular, semiconductor elements utilizing Group-III and Group-V nitride compounds are useful for light emitting devices in the UV and blue/green wavelength regions. For example, gallium nitride (GaN) and related materials such as AlGaN, InGaN and combinations thereof, are the most common examples of nitride semiconductor materials in high demand.

However, manufacturing boules and substrates of some semiconducting materials, such as nitride semiconducting materials has proven difficult for a multitude of reasons. Accordingly, epitaxial growth of semiconducting materials on foreign substrate materials is considered a viable alternative. Substrates including SiC (silicon carbide), $Al_2O_3$ (sapphire or corundum), and $MgAl_2O_4$ (spinel) are common foreign substrate materials.

Such foreign substrates have a different crystal lattice structure than nitride semiconducting materials, particularly GaN, and thus have a lattice mismatch. Despite such mismatch and attendant problems such as stresses and defectivity in the overlying semiconductor materials layer, the industry continues to develop substrate technology to improve viability for semiconductor applications. There is current interest in large surface area, high quality substrates, particularly sapphire substrates. However, challenges remain with the production of high quality substrates in larger sizes.

SUMMARY

According to a first aspect, a method of changing the crystallographic orientation of a single crystal body is provided that includes the steps of characterizing a crystallographic orientation of the single crystal body and calculating a misorientation angle between a select crystallographic direction of the single crystal body and a projection of the crystallographic direction along a plane of a first exterior major surface of the single crystal body. The method further includes removing material from at least a portion of the first exterior major surface to change the misorientation angle.

According to another aspect, a method for crystallographically re-orienting a single crystal body is provided which includes characterizing the single crystal body by correlating a crystallographic orientation of the single crystal body to the orientation of an initial first exterior major surface of the body, and removing material from said initial first exterior major surface to define a modified first exterior major surface that is non-parallel to the initial first exterior major surface to change the crystallographic orientation of the single crystal body.

According to another aspect, an apparatus for changing the crystallographic orientation of a single crystal body is provided that includes a stage configured to hold a single crystal body, the stage comprising interval tilt capabilities about at least one axis and a x-ray gun directed at the stage and a x-ray detector positioned to detect x-rays diffracted from the single crystal body. The apparatus further includes a grinding wheel configured to overlie and engage a single crystal body overlying the stage, the grinding wheel rotatable around an axis and translatable in a direction along the axis.

According to another aspect, an system for completing angled material removal operations on a single crystal body is provided that includes a characterization module having an x-ray gun directed at a characterization stage, an x-ray detector positioned to detect x-rays diffracted from a single crystal body overlying the characterization stage, and an output configured to provide characterization data based on crystallographic orientation of the single crystal body gathered from the diffracted x-rays at the x-ray detector. The system further includes a processing stage having a first actuator having an input to receive a control signal and configured to adjust the orientation of the processing stage for an angled material removal operation based upon the control signal. Further included is a data processing module having an input coupled to the output of the characterization module configured to receive the characterization data, the data processing module having an output coupled to the input of the first actuator to provide a control signal based upon a comparison between the characterization data and predefined crystallographic orientation.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DESCRIPTION OF THE PREFERRED EMBODIMENT(S)

Figure 1:
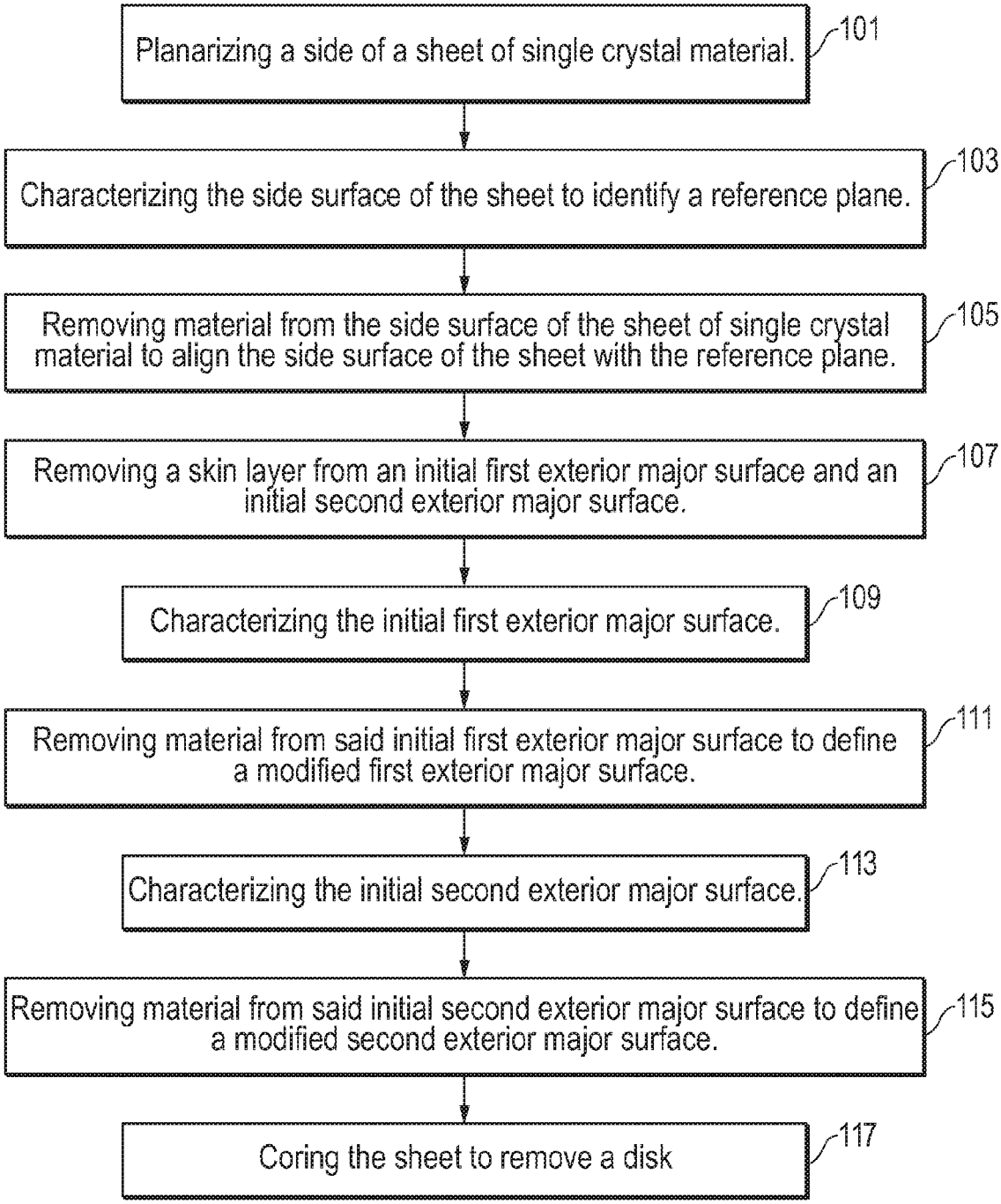
FIG. 1 is a flow chart illustrating a process for crystallographically reorienting a single crystal body according to one embodiment.

Referring to FIG. 1, a flow chart is illustrated that provides a method for crystallographically reorienting a single crystal body. The process is initiated at step 101 by planarizing a side surface of sheet of single crystal material. According to this particular process, the single crystal body is a sheet of single crystal material. As used herein, reference to a sheet or a sheet of single crystal material, refers to a single crystal article having a generally polygonal contour and particularly having opposing generally rectangular major surfaces and side surfaces extending between and joining the opposing generally rectangular major surfaces. Moreover, the sheet of single crystal material is generally a larger piece of material, such that a disk or smaller single crystalline object can be cored from the sheet of single crystal material. The single crystal body can be obtained from suitable crystal forming techniques, such as an Edge-defined Film-fed Growth (EFG) process or Kyropoulos method.

In particular reference to planarizing the side surface of the sheet, planarizing can include a material removal process. A suitable planarizing process includes a grinding process, such as a coarse grinding process, or a fine grinding process. According to one particular embodiment, planarizing a side surface of a sheet includes a coarse grinding process using a fixed abrasive, and notably a bonded abrasive grinding wheel.

Generally, the single crystal body includes an inorganic material. Suitable inorganic materials can include oxides, nitrides, carbides, and combinations thereof. In one particular embodiment, the single crystal body includes a metal oxide, including for example, aluminum oxide or compound oxides, and combinations thereof. More particularly, the single crystal body is a sapphire body, comprising only alumina.

As described below, sapphire single crystal materials have multiple crystallographic planes and corresponding directions. In reference to particular orientations of the sapphire single crystal bodies, typical planes within said sapphire body include a c-plane, r-plane, n-plane, a-plane, and m-plane. Depending upon the desired application of the single crystal body, certain orientations are desirable.

The sheet of single crystal material can have generally polygonal shapes, and in particular generally rectangular portions, and as such have dimensions of length, width, and thickness. Typically, the length is the longest dimension, having a dimension equal to and oftentimes greater than the width or thickness. The width of the sheet is typically the second largest dimension, and is typically greater than the thickness. The thickness is the smallest dimension, and is typically less than the length and width. Generally, the length of the sheet is not less than about 7.5 cm. According to other embodiments, the length of the sheet is greater, such as not less than about 25 cm, or not less than about 50 cm, not less than about 75 cm, or even not less than about 100 cm. Generally, the length of the sheet of single crystal material is not greater than about 200 cm.

The width of the sheet of single crystal material is generally not less than about 7.5 cm. Other embodiments may utilize sheets having greater widths, such as not less than about 10 cm, or not less than about 15 cm, or even not less than about 20 cm. Generally, the width of the single crystal sheets is not greater than about 50 cm.

As described previously, the thickness is generally the smallest dimension, and as such, the single crystal sheet typically has a thickness that is not less than 0.5 mm prior to processing. Other embodiments can utilize sheets of greater thickness, such as sheets having a thickness not less than about 1 mm, or not less than 2 mm, or even not less than about 5 mm. Generally, the thickness of the sheet of single crystal material is not greater than about 20 mm.

After planarizing a first side surface of the sheet at step 101, it will be appreciated that the opposing opposite side surface of the sheet of single crystal material may also be planarized. As such, this planarization step typically includes the same processes as used to planarize the first side of the sheet, and particularly, a grinding process.

Referring again to FIG. 1, after planarizing a side of the sheet at step 101, the process continues at step 103 by characterizing the side of the sheet of single crystal material to identify a reference plane. Characterization techniques can include direct characterization techniques that take measurements directly from the surface, or alternatively, the characterization process can include an indirect technique whereby the orientation of the crystal is derived through measurement along another surface. According to one embodiment, the process of characterizing the side of the sheet can be carried out via x-ray diffraction. In reference then to the characterizing of the side of the single crystal material to identify a reference plane, in the particular context of sapphire single crystals, generally, identification of a reference plane includes identification of an a-plane, r-plane, or m-plane. However, it will be appreciated that one of the previously mentioned planes may be used as a reference plane, depending upon the desired orientation of the single crystal body.

After characterizing the side surface of the sheet at step 103, the process can continue by removing material from the side surface of the sheet to align the side surface of the sheet with the identified reference plane, at step 105. Removing material from the side surface of the sheet can include typical abrasive processes, such as grinding, and particularly a coarse grinding or fine grinding process. According to a particular embodiment, a suitable grinding process includes use of a fixed abrasive, such as a grinding wheel.

Moreover, upon identification of a reference plane, the sheet can be angled such that during removal of the material, the material is removed such that the side surface of the sheet is aligned with the reference plane identified. Such a process is suitable for orientation of the side of the sheet, and if so chosen, upon removal of smaller pieces of single crystal material from the sheet, such as a disk, such disks are properly oriented with respect to the identified reference plane.

After removing material from the side of the sheet at step 105, the process continues by removing a skin layer from an initial first exterior major surface and an initial second exterior major surface of the sheet at step 107. As described above, typically the sheet can have a generally polygonal contour having opposing and generally rectangular major surfaces, those being the first exterior major surface and the second exterior major surface. Removal of the skin layer at step 107 can include generally abrasive processes, such as grinding processes, and particularly, a fine grinding process. Generally, the removal of the skin layer includes removal of not greater than about 2 mm of material from the initial first exterior major surface and the initial second exterior major surface. It will be appreciated, that all of the above processes described thus far, notably step 101, step 103, step 105, and step 107 can be completed on single sheets of single crystal material, or alternatively, may be may be completed on multiple sheets. Additionally, such steps may be interchanged.

After removing the skin layer at step 107, the process continues by characterizing the initial first exterior major surface at step 109. According to one embodiment, such characterization can be carried out via diffraction techniques, such as for example x-ray diffraction. In particular, characterizing the initial first exterior major surface can include correlating a crystallographic orientation of the single crystal body to the orientation of the initial first exterior major surface. That is, the overall orientation of particular crystallographic planes and directions of the single crystal body can be compared to the orientation of the initial first exterior major surface. In completing such characterization, typically one or more selected crystallographic planes are identified and compared to the plane defined by the first initial exterior major surface, and in doing so one or more misorientation angles are identified. As used herein, the term "misorientation angle," is defined as the angle between a direction which is normal to a select crystallographic plane within the single crystal body and a selected projection of the corresponding crystallographic direction along the surface of the first exterior major surface or second exterior major surface.

In further describing the crystallographic orientation of the single crystal body, the term, "tilt angle" is also used herein. As such, the tilt angle is a specific term which describes the angle formed between the vector normal to the surface of the single crystal body and a direction normal to a selected crystallographic plane that describes the general orientation of the single crystal body. For example, in the particular context of a sapphire single crystal, the first exterior major surface of the single crystal body may have a generally c-plane orientation. Therefore, the tilt angle describes only the relationship between the vector normal to the crystallographic c-plane and the vector normal to the surface of the single crystal body. Typically, this c-plane orientation is not precisely coplanar with the first exterior major surface of the body and, notably, the c-plane is oriented such that it is tipped toward another crystallographic plane (e.g., the m-plane, a-plane). In fact, c-plane orientation can include a manufactured or intentional tilt angle of the generally planar surface from the c-plane in a variety of directions. For the purposes of clarity, the tilt angle is only a measurement using the vector normal to the surface of the single crystal body, whereas the misorientation angle may describe the angle between a projection (i.e., normal to the plane or within the plane) of the single crystal body and a direction normal to any one of numerous selected crystallographic directions. As such the misorientation angle and the tilt angle may be the same angle when referencing the selected crystallographic plane that describes the general orientation of the single crystal body.

In one particular embodiment, the single crystal body is a sapphire single crystal body having a generally c-plane orientation which is tilted away from the c-plane at a tilt angle of not greater than about 5.0°. Other embodiments may use a sapphire single crystal having a c-plane orientation wherein the tilt angle away from the c-plane is not greater than about 3°, such as not greater than about 2°, or even not greater than about 1°. Typically, the tilt angle is not less than about 0.02°, or not less than 0.05°. Moreover, it will be noted that in some applications, a certain degree of tilt angle is desirable, that is, such that the c-plane is intentionally non co-planar with the first exterior major surface of the body.

After characterizing the initial first exterior major surface at step 109, the process continues at step 111 by removing material from said initial first exterior major surface to define a modified first exterior major surface. Notably, the plane defined by the modified first exterior major surface is non-parallel to the plane defined by the initial first exterior major surface. Thus, the material removal process of step 111 can include removing material from the initial first exterior major surface at an angle. That is, the surface of the single crystal body is tilted or angled during the material removal process. Such a process facilitates crystallographically reorienting the single crystal body, and also redefining misorientation angles.

According to one embodiment, the material removal process can be completed via a grinding process, particularly an angled grinding process. In one particular embodiment, and as will be illustrated in further embodiments, during the grinding process the single crystal body can be fixed in a tilted position, along one or more axes, relative to a grinding surface to effectuate an angled grinding operation. Alternatively, the grinding surface may be tilted along one or more axes relative to the surface of the single crystal body.

During the angled material removal operation, a direction normal to the initial first exterior major surface of the single crystal body can define a first axis, and a direction normal to the grinding surface can define a second axis. This angle between the first axis and second axis also defines the angle between the initial first exterior major surface and the grinding surface during the material removal operation. As such, because the initial first exterior major surface is angled relative to the grinding surface, the first axis and second axis are angled relative to each other and thus not coaxial. Typically the angle between the axes is not greater than about 30°, and more typically, not greater than about 15°. Other embodiments utilize less angle during grinding, such as not greater than about 10°, or not greater than about 5°, or even not greater than about 1°.

By way of clarification, abrasives generally can be categorized as free abrasives and fixed abrasives. Free abrasives are generally composed of abrasive grains or grits in powder form, or particulate form in a liquid medium that forms a suspension. Fixed abrasives generally differ from free abrasives in that fixed abrasives utilize abrasive grits within a matrix of material that fixes the position of the abrasive grits relative to each other. Fixed abrasives generally include bonded abrasives and coated abrasives. An example of a coated abrasive is sandpaper; coated abrasives are typically planar sheets (or a geometric manipulation of a planar sheets to form a belt, flaps, or like), that rely on a flexible substrate on which the grits and various size and make coats are deposited. In contrast, bonded abrasives generally do not rely upon such a substrate, and the abrasive grits are fixed in position relative to each other by use of a matrix bond material in which the grits are distributed. Such bonded abrasive components are generally shaped or molded, and heat treated at a cure temperature of the bond matrix (typically above 750° C.) at which the bond matrix softens, flows, and wets the abrasive grits, and cooled. Various three dimensional forms may be utilized, such as annular, conical, cylindrical, frusto-conical, various polygons, and may form as grinding wheels, grinding blocks, grinding bits, etc. Particular grinding processes described herein utilize fixed abrasive components in the form of bonded abrasives.

According to the embodiment, the material removal process includes a coarse grinding process. Generally, the coarse grinding process can utilize a fixed coarse abrasive that includes coarse abrasive grains in a bond material matrix. The coarse abrasive grains can include conventional abrasive grains such as crystalline materials or ceramic materials including alumina, silica, silicon carbide, zirconia-alumina and the like. In addition to or alternatively, the coarse abrasive grains can include superabrasive grains, including diamond, and cubic boron nitride, or mixtures thereof. Particular embodiments take advantage of superabrasive grains. Those embodiments utilizing superabrasive grains can utilize non-superabrasive ceramic materials such as those noted above as a filler material.

In further reference to the coarse abrasive, the coarse abrasive grains can have a mean particle size of not greater than about 300 microns, such as not greater than about 200 microns, or even not greater than about 100 microns. According to a particular embodiment, the mean particle size of the coarse abrasive grains is within a range of between about 2.0 microns and about 300 microns, such as within a range of between about 10 microns and 200 microns, and more particularly within a range of between about 10 microns and 100 microns. Typical coarse grains have a mean particle size within a range of about 25 microns to 75 microns.

As described above, the coarse abrasive includes a bond material matrix. Generally, the bond material matrix can include an organic or inorganic material. Suitable organic materials can include materials such as resins. Suitable inorganic materials can include ceramics, glasses, metals, or metal alloys. Suitable ceramic materials generally include oxide, carbides and nitrides. Particularly suitable glass materials can include oxides. Suitable metals include iron, aluminum, titanium, bronze, nickel, silver, zirconium, alloys thereof and the like. In one embodiment, the coarse abrasive includes not greater than about 90 vol % bond material, such as not greater than about 85 vol % bond material. Typically, the coarse abrasive includes not less than about 30 vol % bond material, or even not less than about 40 vol % bond material. In a particular embodiment, the coarse abrasive includes an amount of bond material within a range of between about 40 vol % and 90 vol %. Examples of particular abrasive wheels include those described in U.S. Pat. Nos. 6,102,789; 6,093,092; and 6,019,668, incorporated herein by reference.

Generally, the coarse grinding process includes providing an unfinished single crystal body on a holder and rotating the single crystal body relative to a coarse abrasive surface. In one particular embodiment, the grinding wheel can have an abrasive rim extending around the periphery of an inner wheel of the grinding wheel. The single crystal body can be rotated relative to the grinding wheel, and such rotation can be in the same direction of the rotation of the grinding wheel or the opposite direction relative to the rotation of the grinding wheel, while grinding is effected due to the offset rotational axes. According to one embodiment, the grinding process includes rotating the abrasive wheel at a speed of greater than about 2000 revolutions per minute (rpm), such as greater than about 3000 rpm, such as within a range of 3000 to 6000 rpm. Typically, a liquid coolant is used, including aqueous and organic coolants.

In a particular embodiment, a self-dressing coarse abrasive surface is utilized. Unlike many conventional fixed abrasives, a self-dressing abrasive generally does not require dressing or additional conditioning during use, and is particularly suitable for precise, consistent grinding. In connection with self-dressing, the bond material matrix may have a particular composition, porosity, and concentration relative to the grains, to achieve desired fracture of the bond material matrix as the abrasive grains develop wear flats. That is, the bond material matrix fractures as wear flats develop due to increase in loading force of the matrix. Fracture desirably causes loss of the worn grains, and exposes fresh grains and fresh cutting edges associated therewith. In particular, the bond material matrix of the self-dressing coarse abrasive can have a fracture toughness less than about 6.0 MPa-m$^{1/2}$, such as less than about 5.0 MPa-m$^{1/2}$, or particularly within a range of between about 1.0 MPa-m$^{1/2}$ and 3.0 MPa-m$^{1/2}$.

Generally, a self-dressing coarse abrasive partially replaces the bond material with pores, typically interconnected porosity. Accordingly, the actual content of the bond material is reduced over the values noted above. In one particular embodiment, the coarse abrasive has a porosity not less than about 20 vol %, such as not less than about 30 vol %, with typical ranges between about 30 vol % and about 80 vol %, such as between about 30 vol % to about 70 vol %. According to one embodiment, the coarse abrasive includes about 50 vol % to about 70 vol % porosity. It will be appreciated that, the porosity can be open or closed, and in coarse abrasives that have a greater percentage of porosity, generally the porosity is open, interconnected pores. The size of the pores can generally be within a range of sizes between about 25 microns to about 500 microns, such as between about 150 microns to about 500 microns. The foregoing pore-related values and those described herein are made in connection with various components pre-machining or pre-grinding.

According to one embodiment, the coarse abrasive grain content is confined in order to further improve self-dressing capabilities. For example, the coarse abrasive contains not greater than about 50 vol %, not greater than 40 vol %, not greater than 30 vol %, such as not greater than about 20 vol %, or even not greater than about 10 vol % coarse abrasive grains. In one particular embodiment, the coarse abrasive includes not less than about 0.5 vol % and not greater than about 25 vol % coarse abrasive grains, such as within a range of between about 1.0 vol % and about 15 vol % coarse abrasive grains, or particularly within a range of between about 2.0 vol % and about 10 vol % coarse abrasive grains.

During the angled material removal process utilized for crystallographic reorientation, generally not less than about 200 microns of material are removed from the first exterior major surface to define the modified first exterior major surface. Other embodiments may remove a greater amount of material depending upon the desired orientation, such as not less than about 300 microns, or not less than about 400 microns of material. Typically, the amount of material that is removed to define the modified first exterior major surface is not greater than about 700 microns. It will be appreciated that when referring to the amount of material removed, because the angled material removal process is capable of removing different amounts of material from different portions of the surface, such values represent the greatest amount of material removed from a portion of the surface of the single crystal body.

After completing the angled material removal process to define a modified first exterior major surface at step 111, the process continues at step 113 by characterizing the initial second exterior major surface. As described above, generally the initial second exterior major surface has an opposing major plane or surface of the first exterior major surface. Characterization of the initial second exterior major surface, may be carried out in accordance with process described above with relation to characterization of the initial first exterior major surface. Alternatively, characterization of the initial second exterior major surface may be an optional process as the crystallographic orientation of the single crystal body may be known through the characterization of the initial first exterior major surface, and the misorientation angle can be calculated and adjusted based upon the initial characterization.

Accordingly, after the optional characterization of the initial second exterior major surface at step 113, the process continues at step 115 by removing material from said initial second exterior major surface to define a modified second exterior major surface. As will be appreciated, the removal of material from the initial second exterior major surface to define a modified second exterior major surface can include those processes as described above in accordance with step 111. Notably, the single crystal body can be angled relative to a grinding surface such that material is removed at an angle from the initial second exterior major surface to define a modified second exterior major surface, thereby crystallographically reorienting the single crystal body and changing the misorientation angle.

In particular reference to the misorientation angles, generally before undertaking the removal of material from both initial first and initial second exterior major surfaces, the misorientation angles of the single crystal body are generally greater than about 0.05°. According to one embodiment, the misorientation angles are greater prior to the material removal process, such as greater than about 0.1°, or greater than about 0.2°, or even greater than about 0.3°. Still, after performing the material removal process to define modified surfaces and complete the crystallographic reorientation, the misorientation angle can be reduced, such that the misorientation is not greater than about 0.05°. Other embodiments have misorientation angles which are less after material removal, such as not greater than about 0.04°, not greater than about 0.03°, or even not greater than about 0.02°.

As such, the removal of material to define the modified first exterior major surface and the modified second exterior major surface generally changes the one or more misorientation angles by a delta (Δ) of not less than about 0.01°. Other embodiments are capable of changing the misorientation angle by a greater delta, such as not less than about 0.05°, or not less than 0.1°, or not less than about 0.2°, or even not less than about 0.5°. Generally, the change to the one or more misorientation angles is not greater than about 10°, and more particularly, not greater than about 5°.

Referring again to FIG. 1, after removing material from both major surfaces of the sheet, the process continues at step 117 by coring the sheet to remove a disk. Generally, the coring process to remove the disk can include a cutting process. In particular, the cutting process can utilize an abrasive water jet machining operation to remove one or more disks from the larger sheet. Alternatively, in another embodiment, the coring operation can include a core drilling operation wherein the core drilling operation is an ultrasonic assisted core drilling operation. As will be appreciated, said disk removed from the sheet of single crystal material will have the same crystallographic orientation as the processed sheet.

One or more disks may be removed from the larger sheet of single crystal material. A disk generally describes a single crystal article having a substantially circular outer periphery and a first major surface and a second major surface with side surfaces extending between and joining the first major surface and second major surface. It will be appreciated, that such disks can form wafers, that is, a disk may be one wafer, or alternatively, a disk may be later processed to form a plurality of wafers.

It will be appreciated that prior to removing the disks or after removing the disks, the remaining single crystal bodies can undergo further processing to make the articles suitable for use. Typically, further processing can include additional grinding processes, such as a fine grinding operation, lapping operation or polishing operation. During such a fine grinding operation, the scratches formed during a previous coarse grinding operation, such as the angled material removal operation, are removed. As such, the fine grinding operation removes not greater than about 200 microns of material. Other fine grinding operations may remove less, such as not greater than about 100 microns, or not greater than about 50 microns, or even not greater than about 25 microns. Generally, however, the fine grinding operation removes not less than about 10 microns of material.

Typically, after such finishing operations the single crystal bodies can also be subjected to a stress relief process. Such processes may include an etching or annealing process. Moreover, further processing may be undertaken, such as polishing to ensure proper geometries. Typically, such polishing operations include use of a free abrasive, such as a CMP process.

Figure 2:
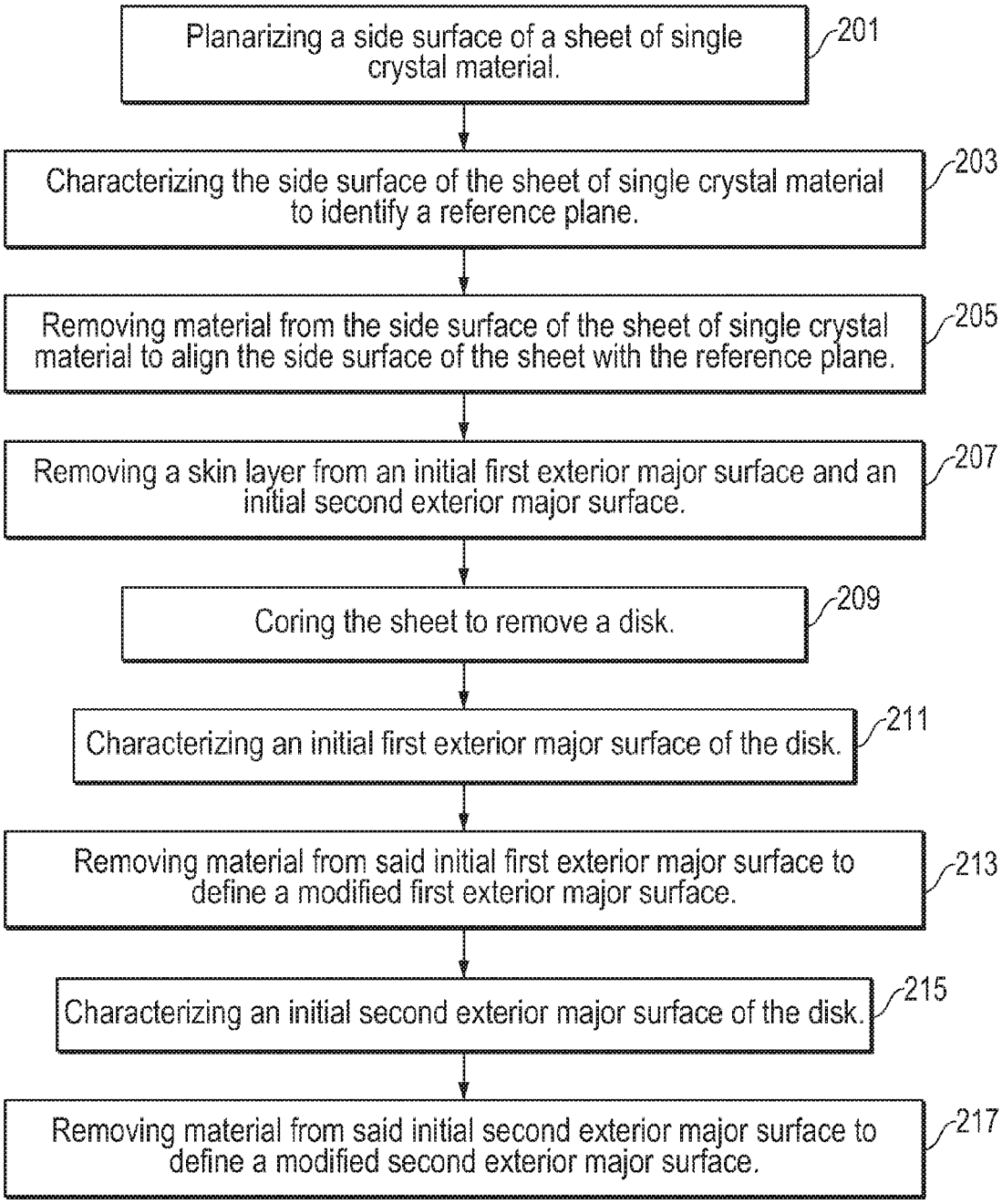
FIG. 2 is a flow chart illustrating another process for crystallographically reorienting a single crystal body according to one embodiment.

Referring to FIG. 2, a flow chart is provided that illustrates a process for forming a crystallographically reoriented single crystal body according to another process. In particular, FIG. 2 is a process directed to crystallographically reorienting disks of single crystal material, which may be later formed into one or more wafers, as opposed to FIG. 1, which is directed to crystallographically reorienting a sheet of single crystal material from which disks were later cored. Accordingly, the processing steps are generally the same, with the exception that the disks are cored from the single crystal sheets early in the process and each of the disks are individually subject to a material removal operation. As can be seen in FIG. 2, steps 201, 203, 205 and 207 are the same steps that were undertaken in FIG. 1. Accordingly, after initial planarizing of the sheet characterizing the side of the sheet, removing material from the side of the sheet to align the side of the sheet with a reference plane, and removing a skin layer, disks may be cored from the sheet of single crystal material at step 209. After coring the sheet to remove a disk at step 209, the processes continue in the same manner as described in accordance with FIG. 1. As such, steps 211-217 are the same with the exception that they are completed on disks instead of sheets.

In particular reference to the geometry of a disk, generally the disk has a substantially circular outer periphery. Moreover, the disk generally has a diameter of not less than about 7.5 cm. According to another embodiment, the diameter of the disk may be greater, such as not less than about 8 cm or 9 cm or even not less than about 10 cm. Typically, the diameter of the disk is not greater than about 30 cm.

Generally, the thickness of a disk is not greater about 10 mm before removing material. Other embodiments, may utilize a disk having a thinner profile, such that the thickness is not greater than about 5 mm, or not greater than about 2.5 mm or even not greater than about 0.5 mm prior to removal of material from both major exterior surfaces.

Figure 3A:
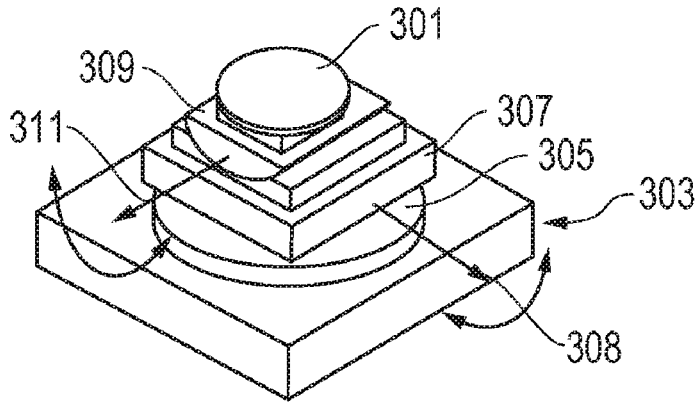
FIGS. 3A-3D include perspective views of a single crystal body and a stage suitable for a material removal process according to one embodiment.

FIGS. 3A-3D, a perspective view of a single crystal disk being processed through a material removal process is illustrated. Referring to FIG. 3A, a disk 301 is placed on a stage 303 that includes a plurality of portions. Notably, the stage 303 includes a portion 305 which is rotatable portion facilitating rotation of the disk during a material removal operation. The stage 303 further includes a first tilting portion 307 which is capable of tilting the overlying disk around an axis 308. The stage further includes a second tilting portion 309 which facilitates tilting the disk 301 around an axis 311. Notably, the axes 308 and 311 are orthogonal axes extending in directions parallel to the plane of the disk. Such an arrangement effectuates tilting of the disk 301 for selective removal of material with respect to a plurality of angles through 360 degrees of rotation. Notably, the tilting portions 307 and 309 have interval tilting capabilities such that each interval of tilt is not greater than about 0.025 degrees, and more typically not greater than about 0.02 degrees. Other stages can utilize greater precision, such that the each tilt interval is not greater than about 0.01 degrees.

Figure 3B:
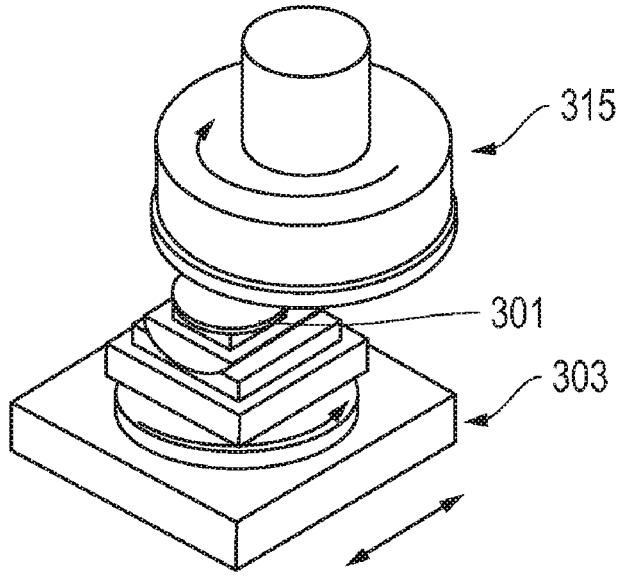

Referring to FIG. 3B, a perspective view of the disk 301 on the stage 303 with respect to a grinding apparatus 315 is illustrated. As illustrated, after the disk is tilted at the selected angle, removal of material from the initial first exterior major surface of the disk 301 can be undertaken. As described above, one such process for material removal is a grinding process, and thus a grinding apparatus 315 is engaged with the disk 301. Notably, in addition to the grinding apparatus 315 being rotated, the stage 303 and the disk 301 can be rotated. According to one embodiment, the grinding apparatus 315 and the stage 303 are rotated in opposite directions. In addition to the rotary motion, the stage can also be translated in a direction along axis 317, and more particularly, the stage 303 and disk 301 can be reciprocated back and forth along the axis 317.

Figure 3C:
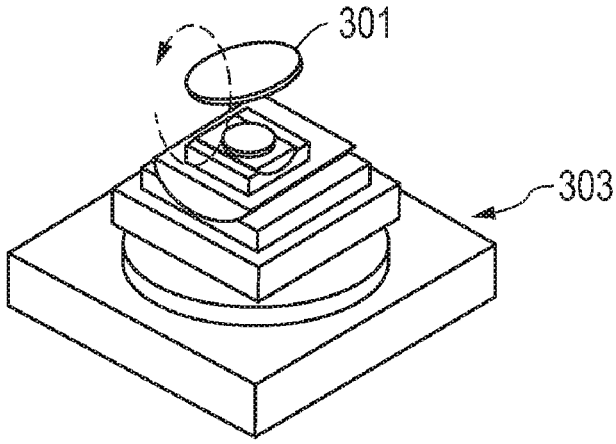

FIG. 3C illustrates the disk 301 being turned over to expose the initial second exterior major surface. After the material is removed from the initial first exterior major surface to define a modified first exterior major surface the disk 301 can be turned over on the stage 303 to initiate material removal from the initial second exterior major surface. As will be appreciated, after forming the modified first exterior major surface the surface is angled and suitably oriented such that upon flipping the disk 301 over, a material removal process can be completed on the initial second exterior major surface without another characterization step.

Figure 3D:
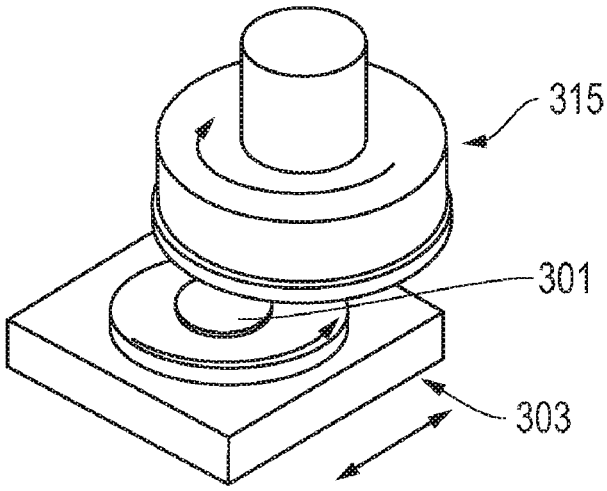

Referring to FIG. 3D, after the disk 301 is turned over, an initial second exterior major surface of the disk 301 is exposed for a material removal process. As illustrated and according to one embodiment, such a material removal process again incorporates a grinding operation. However, as illustrated, because the initial first exterior major surface of the disk 301 has been modified as described above and the orientation of the disk 301 has been changed relative to the modified first exterior major surface, upon grinding the initial second exterior major surface, the disk 301 may not need to be tilted. During this operation, the initial second exterior major surface is subject to a grinding operation to modify the crystallographic orientation of the initial second exterior major surface and the make the second exterior major surface substantially parallel with the plane defined by the modified first exterior major surface.

Figure 4A:
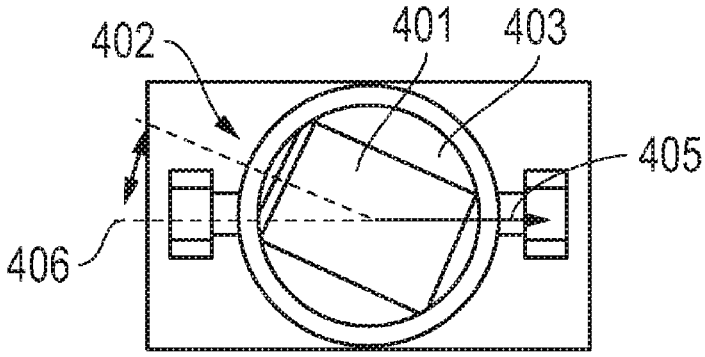
FIGS. 4A-4E illustrate orientation of a single crystal body on a stage for an angled material removal process according to one embodiment.

FIGS. 4A-4F provide views of an alternative material removal operation. Referring to FIG. 4A, a top view of a single crystal body overlying a stage 402 which has a rotatable portion 403 and tilt capabilities 405 suitable for tilting the stage 402 around one tilt axis 406. Accordingly, after characterization of the single crystal body 401 at the first initial exterior major surface and determination of the misorientation angle, the single crystal body 401 can be placed and oriented on the stage 402. As illustrated in FIG. 4A, a first step in the material removal step includes rotating the single crystal body 401 on the stage 401 using the rotatable portion 403 until the single crystal body 401 is desirably oriented with respect to the tilt axis 406.

Figure 4B:
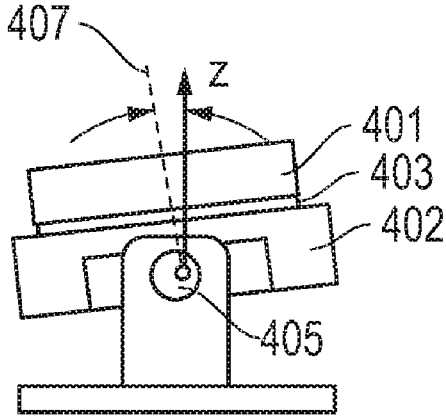

Referring to FIG. 4B, a side view of the single crystal body 401 on the stage 402 is provided. After rotating the single crystal body 401 on the stage 401 the single crystal body 401 can be further oriented for the angled material removal process by tilting the stage by via the tilt capabilities 405. As illustrated, the single crystal body 401 can be tilted around the tilt axis 406, which as illustrated in FIG. 4B, is perpendicular to the Z direction and coaxial with the X-direction. Tilting of the single crystal body 401 angles the single crystal body such that the direction 407 that is normal to the plane defined by the initial first exterior major surface is not coaxial with the Z-direction, thus facilitating an angled material removal process and a change in the crystallographic orientation of the single crystal body 401 with respect to the surface of the single crystal body 401.

Figure 4C:
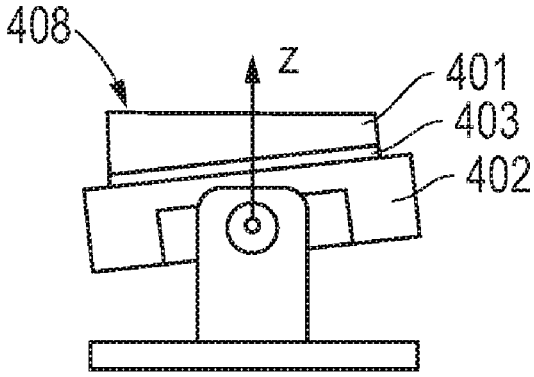
Figure 4D:
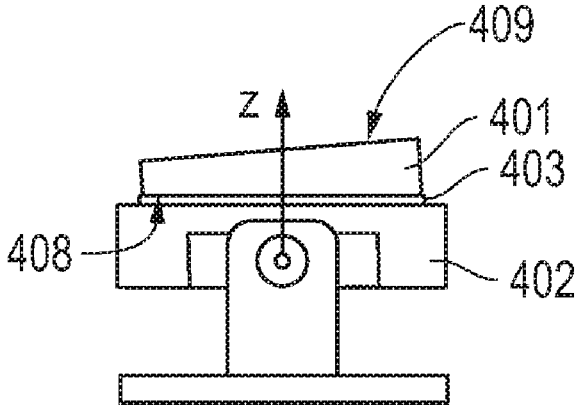

FIG. 4C illustrates a side view of the single crystal body 401 on the stage 402 after undergoing a material removal process. Notably, after orienting the single crystal body 401 by completing a suitable rotation and tilt process, the material removal process can be undertaken. As described above, one suitable material removal process includes a grinding process. As illustrated in FIG. 4C, the grinding process is undertaken such that the initial first exterior major surface is removed at an angle relative to the plane defined by initial first exterior major surface thereby defining a modified first exterior major surface 408. Accordingly, the single crystal body 401 will be shaped such that a portion of the body has a different cross-sectional thickness than other parts of the body.

Figure 4E:
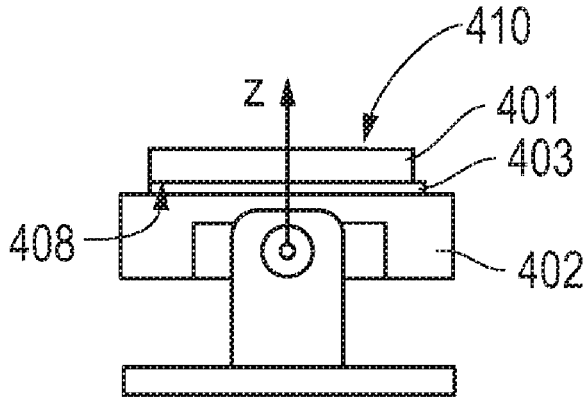

FIG. 4E illustrates a side view of the single crystal body 401 on the stage 402. In particular, after removing material to define the modified first exterior major surface 408, the stage 402 can be returned to its original, untilted position. In this position, the single crystal body 401 can be turned over such that the modified first exterior major surface 408 is in contact with the stage 402 and the opposing major surface, that is the initial second exterior major surface 409, is exposed for a material removal process. Suitable crystallographic reorientation of the single crystal body 401 with respect to the initial second exterior major surface may not require a characterization process or a tilting process according to this particular embodiment, as the first exterior major surface has been modified and the desired crystallographic reorientation has been initiated with respect to the first surface.

Figure 4F:
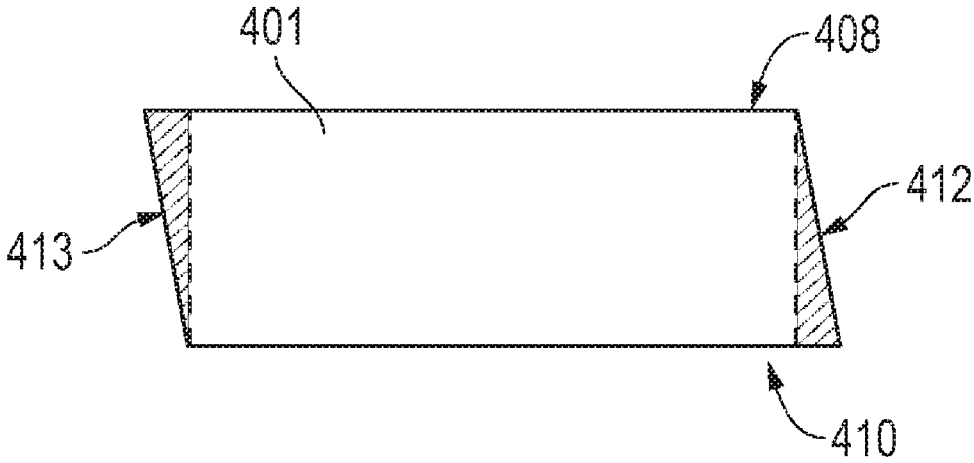
FIG. 4F illustrates a cross sectional view of a single crystal body according to one embodiment.

Referring to FIG. 4F, a side view of the single crystal body 401 on the stage 402 after completion of an angled material removal process is illustrated. As illustrated, the initial second exterior major surface has been removed and a modified second exterior major surface 410 has been formed. The modified second exterior major surface 410 defines a plane that is parallel to the plane defined by the modified first exterior major surface 408.

FIG. 4F is a cross-sectional view of a single crystal body 401 after processing both major surfaces for crystallographic reorientation. Notably, the illustrated single crystal body 401 has a modified first exterior major surface 408, a modified second exterior major surface 410, and angled sides 412 and 413. It will be appreciated that due to the angled material removal processes to the major surfaces, the sides 412 and 413 can exhibit an angle giving the single crystal body a parallelogram type cross-sectional shape. According to one embodiment, after forming the modified first and second exterior major surfaces 408 and 410, the sides 412 and 413 of the single crystal body 401 can undergo a material removal process, such as a grinding process, to make the sides perpendicular to the major surfaces. As illustrated in FIG. 4F, the shaded portions indicate the volume typically removed from the sides during such a process.

Figure 5:
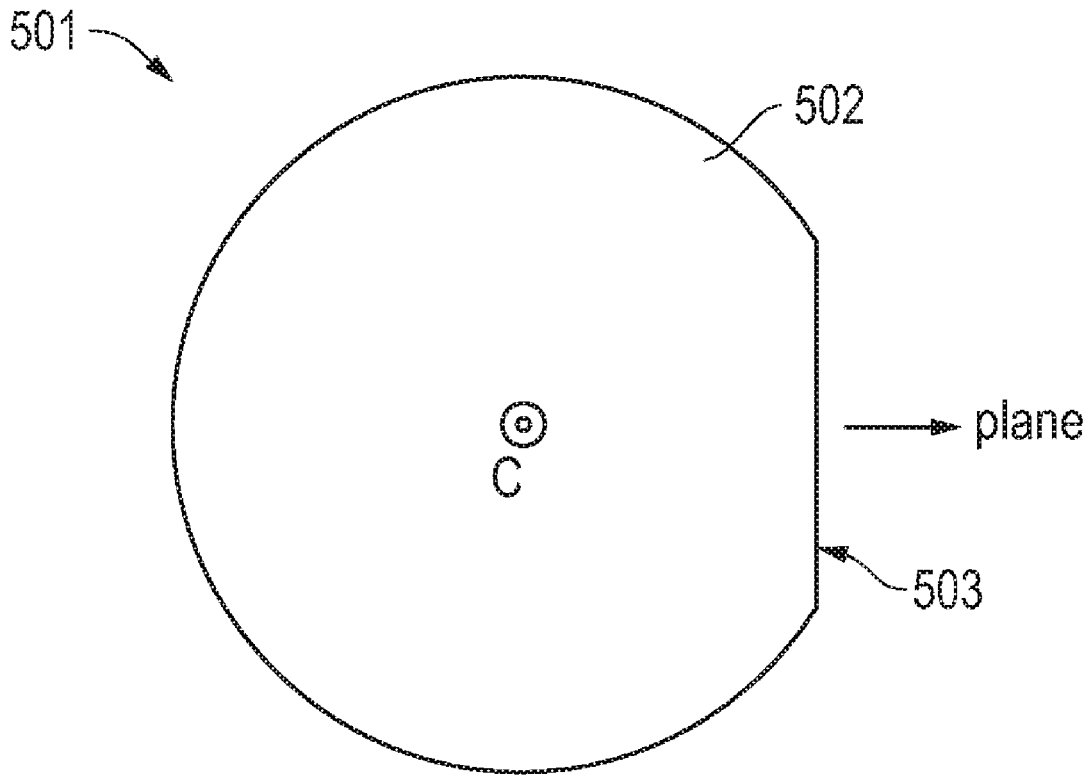
FIG. 5 is a top view illustrating a sapphire single crystal wafer having a generally c-plane orientation and a reference flat according to one embodiment.

In particular reference to the types of single crystal materials, according to one embodiment, a suitable single crystal body for crystallographic reorientation can include a sapphire single crystal. As such, FIG. 5 illustrates a top view of a sapphire single crystal body 501. Notably, the single crystal body 501 is in the shape of a disk, and more particularly in the shape of a wafer suitable for forming electronic devices thereon. While it will be appreciated that sapphire single crystal bodies can have different orientations, such as an a-plane orientation, an r-plane orientation, an m-plane orientation, or a c-plane orientation, the illustrated embodiment of FIG. 5 illustrates a single crystal sapphire wafer having a generally c-plane orientation, as the top surface 502 of the single crystal body 501 is defined primarily by the crystallographic c-plane. As further illustrated, the single crystal body 501 includes a reference flat 503 corresponding to a crystallographic-plane of the sapphire crystal, which may correspond to another plane besides the c-plane, such as the a-plane, m-plane, or r-plane.

Figure 6A:
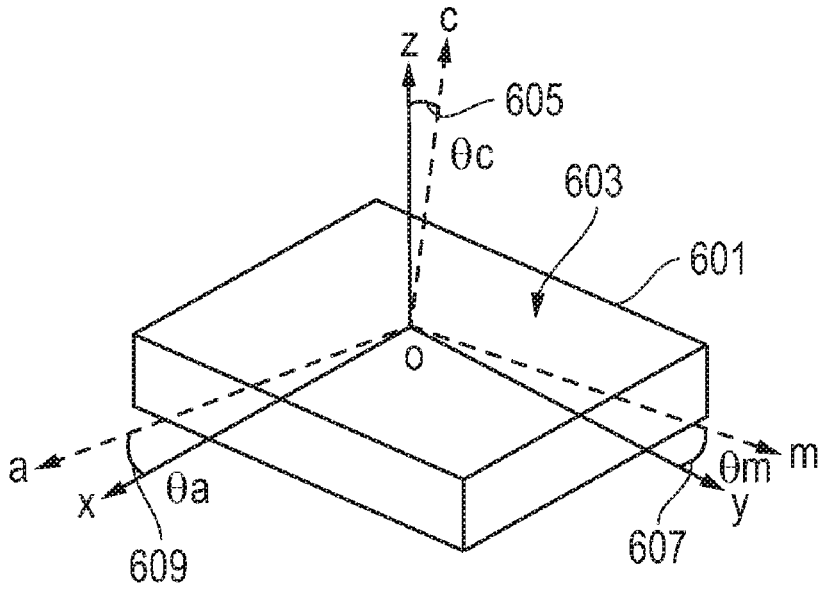
FIG. 6A is a perspective view of a sapphire single crystal body and particular misorientation angles according to one embodiment.

For further clarity FIGS. 6A-6D are provided which illustrate a sapphire single crystal body and misorientation angles ($\theta_c$, $\theta_a$, and $\theta_m$) relative to particular crystallographic planes within the single crystal body and directions (or projections) corresponding to these planes in the surface of the single crystal body. In particular, FIG. 6A illustrates a perspective view of a single crystal body 601, having a first set of axes representing three directions (x, y, and z) corresponding to projections of the a, m, and z crystallographic directions respectively within the initial first exterior major surface 603 of the single crystal body 601. Additionally, FIG. 6A includes a second set of axes representing three directions (a, m, and c) corresponding to crystallographic directions (i.e., directions that are normal to correspondingly labeled crystallographic planes) within the single crystal body 601. FIG. 6A further illustrates misorientation angles 605, 607, and 609 corresponding to differences between the axes representing the three directions (x, y, and z) and the axes representing the three crystallographic directions (a, m, and c). More particularly, the misorientation angles 605, 607, and 609 represent a misorientation between projections along the initial first exterior major surface 603 and corresponding crystallographic directions within the single crystal body 601.

Figure 6B:
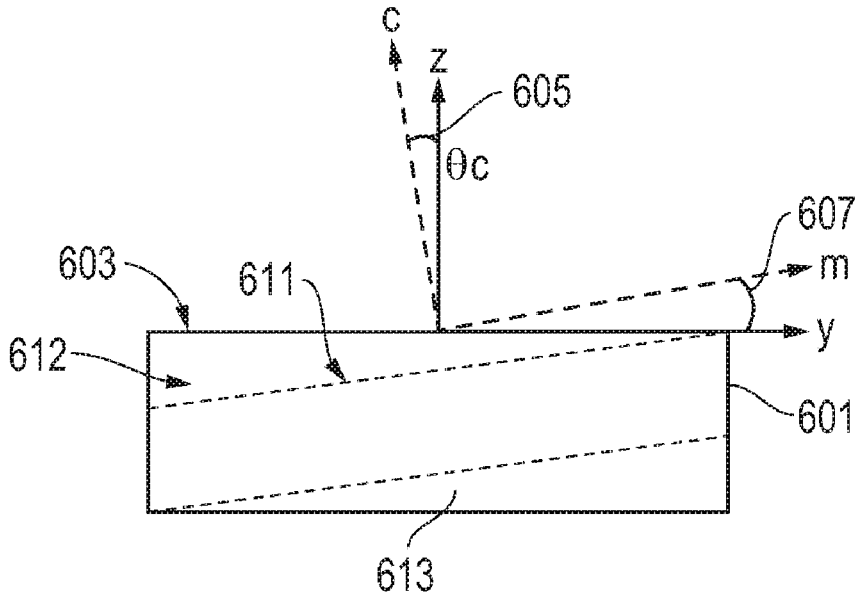
FIG. 6B is a cross-sectional view of a sapphire single crystal body along a x-axis and the change of misorientation angles according to one embodiment.

FIG. 6B is a cross-sectional view of the single crystal body 601 as viewed along the x-axis. In particular, FIG. 6B illustrates the misorientation angles 605 (which is also the tilt angle) and 607 between the z and y directions respectively. According to embodiments described herein, the single crystal body can undergo a material removal process to change the initial first exterior major surface 603 to a modified first exterior major surface 611 that is non-parallel to the initial first exterior major surface 603. As previously described, the material removal process can include a grinding process, and can include tilting the initial first exterior major surface of the single crystal body 601 relative to a grinding surface. In order to change the crystallographic orientation of the single crystal body, and in particular, to change the misorientation angles 605 and 607 associated with the c-plane and the m-plane respectively, material is removed from the single crystal body 601 to define a modified first exterior major surface 611. For the purposes of clarity and illustration, triangular-shaped regions 612 and 613 illustrate the angled material removal process and particularly regions 612 and 613 are removed such that the initial first exterior major surface 603 is removed to define a modified first exterior major surface 611 which is non-parallel to the initial first exterior major surface 603. Upon material removal and formation of the modified first exterior major surface 611, the c-plane and m-plane are reoriented with respect to the modified first exterior major surface 611 and thus the degree of misorientation with respect to the m-plane and c-plane can be changed.

Figure 6C:
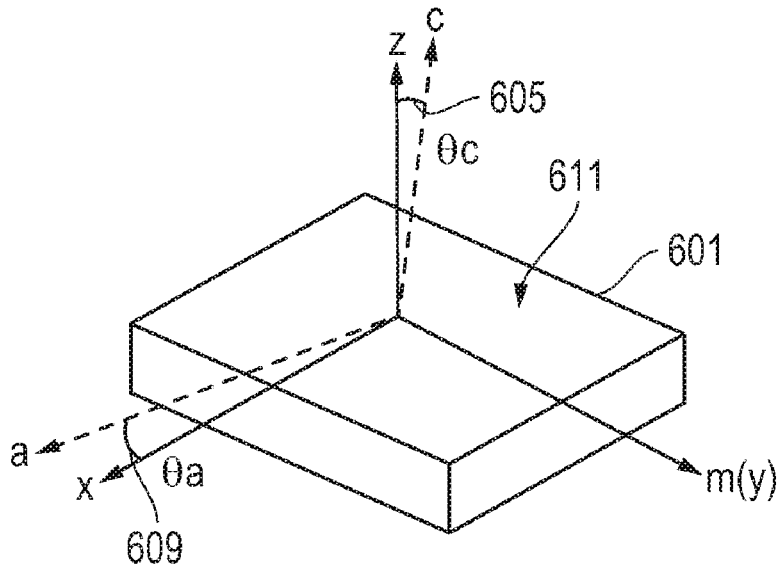
FIG. 6C is a perspective view of a sapphire single crystal body and particular misorientation angles according to one embodiment.

Referring to FIG. 6C, after forming a modified first exterior major surface 611, the y-axis and m-plane direction share the same vector. As such, the same process can be completed such that the misorientation angle with respect to the x-axis and a-plane direction can be changed.

Figure 6D:
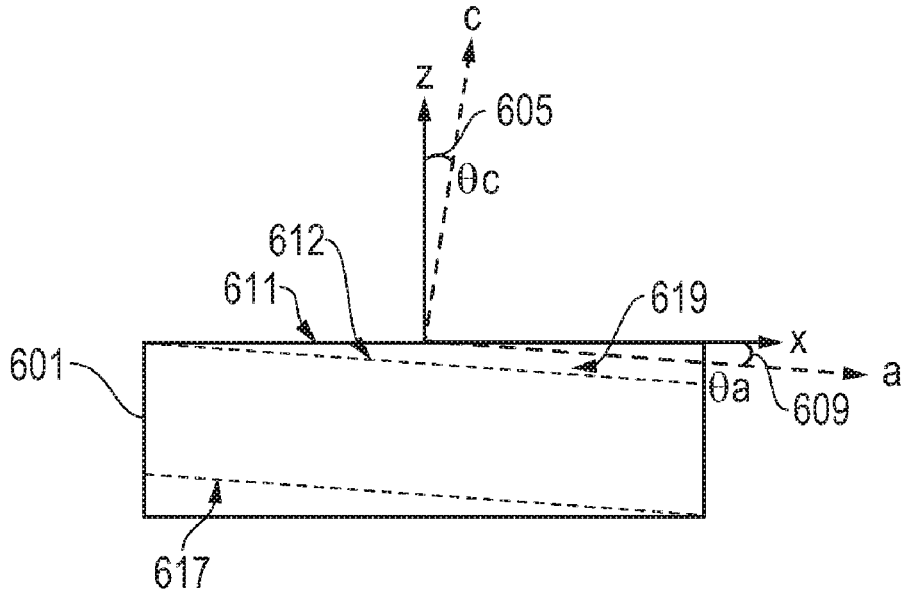
FIG. 6D is a cross-sectional view of a sapphire single crystal body along a y-axis and the corresponding misorientation angles according to one embodiment.

FIG. 6D illustrates a cross-sectional view of the sapphire single crystal body 601 as viewed along the y-axis. FIG. 6D illustrates the misorientation angles 605 and 609 between the z-axis the x-axis respectively. The previous reorientation forming the modified first exterior major surface 611 with respect to the y-axis and m-plane normal direction effectively redefined the initial first exterior major surface for the sapphire single crystal body 601. As such, the sapphire single crystal body 601 can undergo a second material removal process to effect a crystallographic reorientation and change the misorientation angles 605 and 609 by characterizing and processing the surface of the single crystal body in the x-axis. As illustrated, the sapphire single crystal body can be subject to a material removal process, such as grinding, where the modified first exterior major surface 611 is tilted with respect to a grinding surface such that a modified second exterior major surface 612 is defined with respect to the x-axis. During such as grinding process, the triangular-shaped regions 612 and 613 are removed such that the c-plane and a-plane are reoriented with respect to the modified second exterior major surface 612 and thus the degree of misorientation with respect to the a-plane is changed. It will be appreciated that the while the grinding process has been described as a multi-step process with respect to a single grinding process for each of two different orthogonal directions (i.e., y-axis and x-axis), the grinding process can be modified as described in embodiments herein to effectuate a change in crystallographic orientation in multiple directions in a single grinding process.

Figure 7:
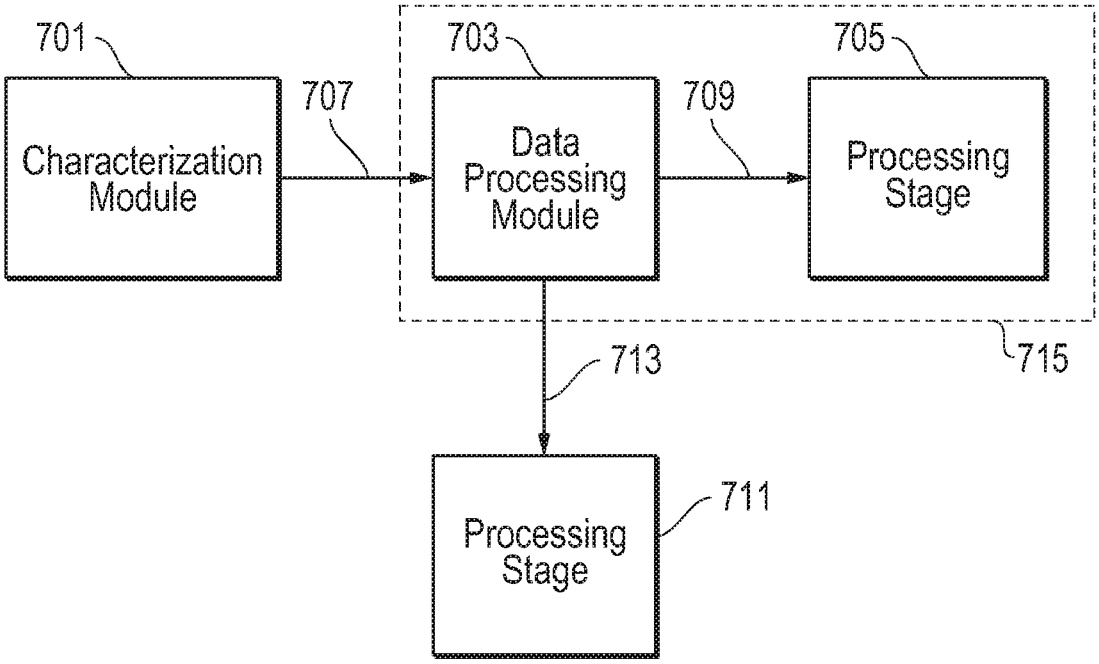
FIG. 7 illustrates a diagram of a system for angled material removal operations of a single crystal body according to one embodiment.

Referring to FIG. 7 a system for completing angled material removal operations is illustrated. FIG. 7 illustrates a characterization module 701 having an output connected to an input of a data processing module 703. The data processing module also includes a first output connected to an input of a first processing stage 705 and a second output connected to an input of a second processing stage 711.

Generally, the characterization module 701 includes a x-ray gun and a x-ray detector oriented around a characterization stage for characterizing a single crystal body. Upon characterization of the single crystal body, the characterization module generates characterization data 707 particular to the single crystal body and can provide the characterization data 707 to the data processing module 703. The characterization data 707 typically includes data relevant to the orientation of the crystal. According to one embodiment, the characterization data 707 can include data that relates the physical orientation of the single crystal body as determined by its physical exterior surfaces to a crystallographic orientation. In one particular embodiment, the characterization data 707 includes information relevant to identifying a reference plane within the single crystal body. In another embodiment, the characterization data 707 can include information relevant to misorientation angles with respect to an initial major first exterior surface of the single crystal body.

The data processing module 703 receives the characterization data 707 and generates a control signal for controlling the angled material removal operation at a select processing stage. Because multiple angled material removal operations can be implemented by the system, such as for example an angled material removal operation to form a reference plane or an angled material removal operation to change misorientation angles on an initial first exterior major surface, the data processing module 703 can be used to generate different control signals. Such control signals can then be sent to the appropriate processing stages (e.g., either 705 or 711) to carry out the appropriate operation.

For example, in one embodiment the data processing module 703 receives characterization data 707 from the characterization module 701 and processes the characterization data 707 to generate a control signal which represents an error between the current orientation of the single crystal body and the desired orientation based upon a predetermined crystallographic orientation. The control signal is sent to the processing stage to adjust the orientation of the processing stage. As such, in one particular embodiment, the control signal 709 includes data which is sent to the first processing stage 705 which is suitable for completing an angled material removal process on the first exterior major surface of the single crystal body to change at least one misorientation angle. Alternatively, in another embodiment, the data processing module 703 provides a control signal 713 to the second processing stage 711 which includes data suitable for completing an angled material removal operation on a side surface of the single crystal body to define a reference plane or "flat". Notably, such processes are different and can require different processing stages as well as different control signals since in one operation the first exterior major surface of the single crystal body is being processed, while in the other operation, the side surfaces of the single crystal body are being processed.

Generally, processing of the characterization data 707 by the data processing module 703 can be accomplished via hardware, firmware, or software. For example, the data processing module may include a field programmable gate array (FPGA), an application specific integrated circuit (ASIC), or computer programmable software, or a combination thereof.

Figure 8:
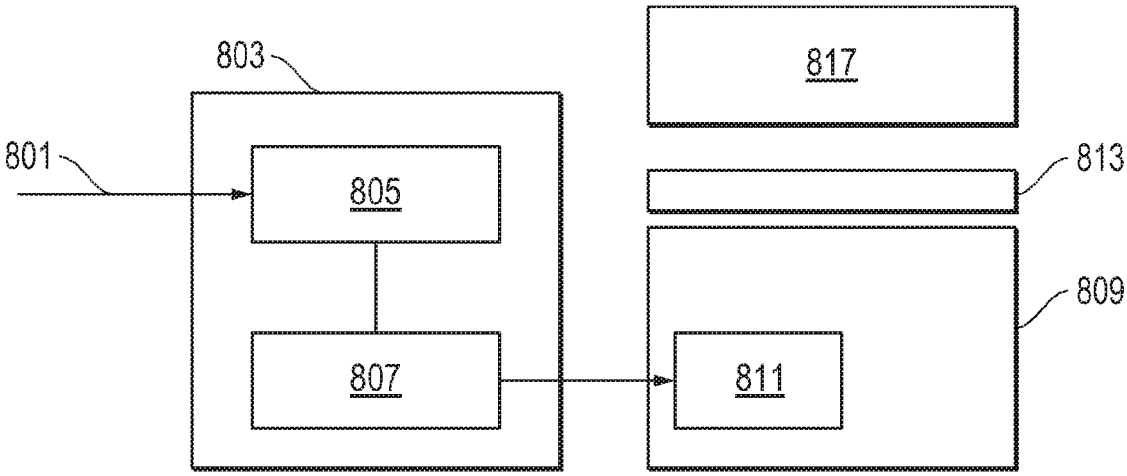
FIG. 8 illustrates a detailed diagram of a portion of the system of FIG. 7 according to one embodiment.

Referring to FIG. 8, the indicated area 715 of FIG. 7 is illustrated in more detail and includes a diagram of a data processing module 803 and a processing stage 809 having a single crystal body 813. The data processing module 803 includes a memory 805 having an input connected to an output of a characterization module for receiving the characterization data 801 and an output connected to a data processor 807. The memory 805 can store instructions for the data processor 807 to retrieve upon receiving characterization data 801 such that the data processor 807 can process the characterization data and generate a control signal 815 to send to the processing stage 809. As described above, the characterization data 801 can include different types of data depending upon the desired process and accordingly the memory 805 and data processor 807 can include multiple programs and algorithms for appropriately altering the characterization data 801 to a control signal 815.

As illustrated, the processing stage 809 includes an actuator 811 which has an input connected to the data processor 807 for receiving the control signal 815. Upon receiving the control signal 815, the actuator adjust the orientation of the processing stage 809 and an overlying single crystal body 813 relative to a grinding surface 817 based upon the control signal 815. According to one embodiment, the actuator 811 can control the tilt of the processing stage 809 around a first axis that is in the plane defined by the major surface of the processing stage 809. According to another embodiment, the processing stage 809 includes more than one actuator to control the motion of the processing stage 809 in multiple directions. As such, in one embodiment, another actuator is used to control the tilt of the processing stage 809 in a second axis that is generally orthogonal to and in the same plane as the first axis. According to another embodiment, the processing stage 809 can include another actuator configured to receive a control signal from the data processor 807, such that the actuator is configured to rotate the processing stage in the plane of the major surface of the processing stage.

As will be appreciated, multiple control signals can be sent to multiple actuators to control the motion of the processing stage in multiple directions. As such, the data processor 803 and processing stage 809 can include additional or intervening components, such as multiplexers and digital logic circuits beyond those illustrated. Moreover, while such embodiments have demonstrated changing the angle of the processing stage 809 relative to a grinding surface 817, such controls can be used to change the angle of the grinding surface 817 relative to the processing stage 809, or alternatively, such controls can be used to control both the grinding surface and the processing stage 809.

Figure 9:
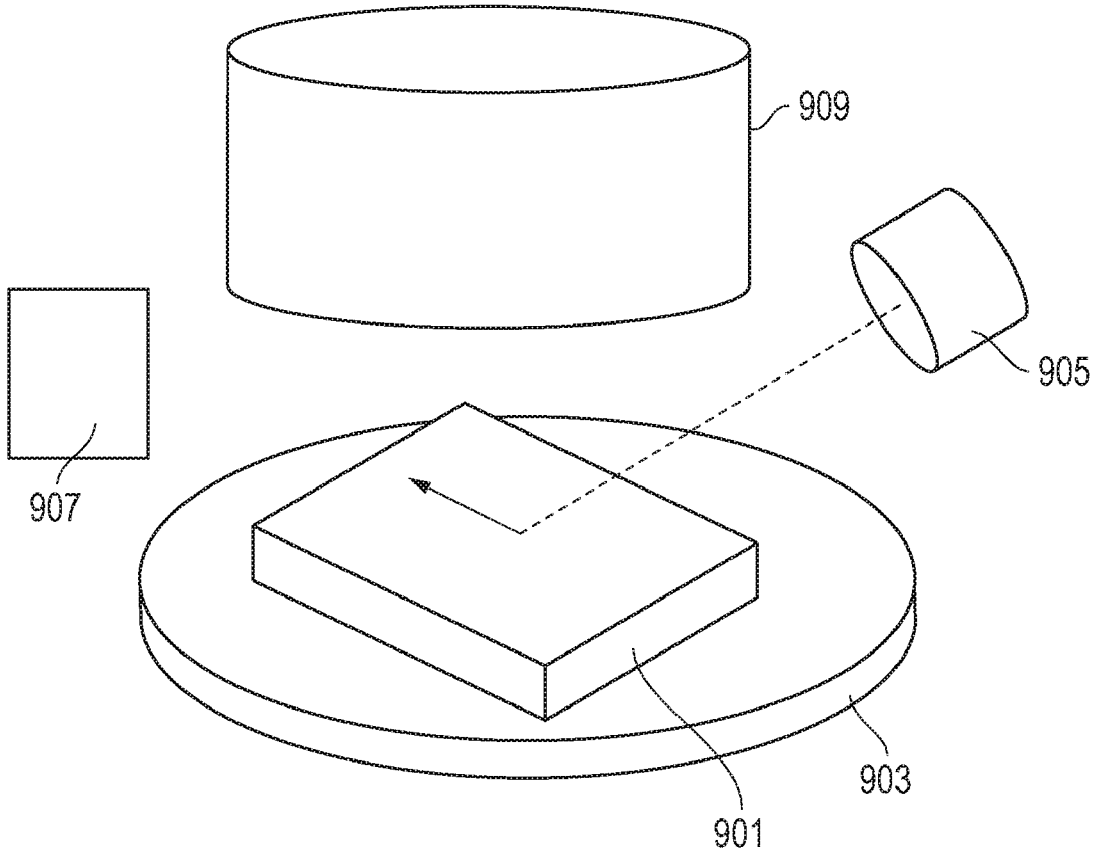
FIG. 9 in a perspective view of an apparatus for crystallographically reorienting a single crystal body according to one embodiment.

FIG. 9 is a perspective view of an apparatus for changing the crystallographic orientation of a single crystal body. FIG. 9 includes a single crystal body 901 overlying a stage 903, a x-ray gun 905 displaced above the stage 903 and directed at the single crystal body 901. As will be appreciated, the stage includes interval tilt capabilities suitable for undertaking an angled material removal process. The apparatus further includes a corresponding detector 907 positioned to detect x-rays generated from the gun 905 and diffracted from the single crystal body 901. The apparatus also combines a grinding surface 909, such as a grinding wheel, overlying the single crystal body 901 and stage 903 and configured to engage the single crystal body during a grinding operation. Such an apparatus facilitates a combination of processes, such as characterization and material removal for crystallographic reorientation of the single crystal body 901. Moreover, the apparatus of FIG. 9 allows for improved control of the reorientation process, as the single crystal body can be characterized before, during, and even after the angled material removal operation.

EXAMPLE

Table 1 below provides data for 21 samples formed according to the following processing procedures. Twenty one, single crystal sapphire disks are cored from multiple larger single crystal sapphire sheets grown via a EFG method. Each of the grown single crystal sheets have a misorientation of approximately +/−0.5 degrees from a selected crystallographic orientation; typically a generally c-plane orientation. Each of the sheets are first visually inspected for defects, and inspected using polarized light, and then using x-ray characterization methods. After inspection of the sheets, each sheet is mapped and marked for the coring operation and removal of single crystal sapphire disks. Generally, 4 single crystal disks are removed from each single crystal sheet.

After the coring operation, each of the single crystal disks are inspected and ground to diameter of about 2 inches. Each single crystal disk is cleaned and characterized using x-ray diffraction to determine the orientation of a particular reference plane which will correspond to the reference flat. After identification of the selected reference plane, for example the a-plane within the sapphire single crystal disks, the flat is formed on the single crystal disk using a surface grinder.

After forming the flat, a single crystal disk is wax mounted onto a flat plate and cleaned via a grinding of a first exterior major surface. After cleaning the sample, the single crystal disk is characterized using x-ray diffraction and the orientation of the first exterior major surface relative to a predetermined crystallographic orientation is calculated. The single crystal disk is secured to a sine plate and the orientation of the single crystal disk relative to a grinding surface is adjusted so that the single crystal disk is angled with respect to a grinding surface. The single crystal disk undergoes an angled grinding operation. Generally, the grinding operation for each of the listed samples below is between about half an hour and about 2 hours, depending upon the correction required.

After the angled grinding operation, the first exterior major surface of each of the single crystal disks is characterized using x-ray diffraction. During characterization, certain misorientation angles of the single crystal disks are measured and recorded. If necessary, the single crystal disks undergo the angled grinding operation again for further correction. After processing the first exterior major surface, the disks are flipped over, and the second exterior major surface is corrected using the same process as used on the first exterior major surface.

After adjusting the orientation of the second exterior major surface, each of the samples are double-sided lapped and cleaned. The side surfaces of each of the single crystal disks are edge-ground, and the disks are cleaned again, annealed, polished, cleaned, and inspected again.

TABLE 1

| Sample | A-Axis Rotation (degrees) | M-Axis Rotation (degrees) | Combined Angle (degrees) | Flat Orientation (degrees) |
|---|---|---|---|---|
| 1 | −0.1 | 0 | 0.1 | −0.2 |
| 2 | −0.06 | 0.04 | 0.08 | −0.13 |
| 3 | −0.09 | 0.03 | 0.09 | −0.02 |
| 4 | −0.09 | −0.02 | 0.1 | −0.08 |
| 5 | −0.08 | −0.01 | 0.08 | −0.02 |
| 6 | −0.02 | −0.11 | 0.12 | −0.2 |
| 7 | 0.07 | −0.13 | 0.14 | −0.23 |
| 8 | −0.07 | −0.08 | 0.11 | −1.89 |
| 9 | 0.03 | 0.03 | 0.04 | −0.02 |
| 10 | −0.07 | 0.02 | 0.07 | −0.08 |
| 11 | −0.04 | 0.15 | 0.16 | −0.07 |
| 12 | −0.03 | 0.01 | 0.04 | −0.25 |
| 13 | −0.02 | 0.01 | 0.02 | −0.15 |
| 14 | 0.02 | 0.05 | 0.05 | −0.12 |
| 15 | 0.02 | −0.11 | 0.11 | −0.17 |
| 16 | 0.05 | 0.18 | 0.19 | −0.14 |
| 17 | −0.07 | 0 | 0.07 | −0.11 |
| 18 | −0.1 | 0.04 | 0.1 | −0.16 |
| 19 | −0.09 | −0.01 | 0.09 | −0.03 |
| 20 | 0.1 | 0.09 | 0.14 | −0.08 |
| 21 | −0.18 | −0.05 | 0.18 | −0.06 |
| Average | −0.04 | 0.01 | 0.1 | −0.2 |
| Std. Dev. | 0.07 | 0.08 | 0.05 | 0.39 |
| Maximum | 0.1 | 0.18 | 0.19 | −0.02 |
| Minimum | −0.18 | −0.13 | 0.02 | −1.89 |
| Specification | | | ≦0.25° | ≦±0.2° |

Table 1 above illustrates the 21 samples processed according to the procedures described above. Each of the sapphire samples has a generally c-plane orientation. Misorientation angles relative to the a-axis and the m-axis corresponding to crystallographic planes within the sapphire single crystal disks are measured and provided above. Notably, the average misorientation angles of the 21 samples relative to the a-axis and m-axis is low (less than about 0.05 degrees). Moreover, as the original orientation of the single crystal sheets was +/−0.5 degrees within a selected crystallographic direction. After the grinding operation, the misorientation angles with respect to the a-axis and the m-axis have average values of −0.04 degrees and 0.01 degrees respectively illustrating a crystallographic reorientation. Additionally, the combined angle of the 21 samples has an average value of 0.1 illustrating a close crystallographic orientation, closer than +/−0.5 degrees. Also, the combined angle misorientation of each of the single crystal disks on a wafer-to-wafer comparison is reduced, as the standard deviation of the 21 samples is 0.05 degrees. The maximum and minimum values with respect to the angles measured also illustrate a reduction in the misorientation.

The embodiments described herein provide notable advantages. The embodiments herein describe characterization methods, orientation processes and procedures, and particular grinding processes and articles, all of which in combination facilitate crystallographically reorienting single crystal bodies. Moreover, such combination of methods are scalable as some processes herein are suitable for processing large sheets of single crystal material, while alternatively, certain combinations of processes are suitable for processing individual disks or wafers of single crystal materials. In particular, the embodiments herein facilitate post-growth crystallographic reorientation of single crystal bodies which is particularly desirable for reducing scrap and improving the quality of devices formed thereon. Moreover, the processes provided herein facilitate manufacturers mobility as single crystal bodies can be engineered and adjusted to end user specifications for particular applications after the single crystal article has been grown.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A method of changing the crystallographic orientation of a single crystal body comprising:

characterizing a crystallographic orientation of the single crystal body;

calculating a misorientation angle between a select crystallographic direction of the single crystal body and a projection of the crystallographic direction along a plane of a first exterior major surface of the single crystal body;

fixing the single crystal body in a position that is tilted along a first axis with respect to the initial first exterior major surface of the body and removing material from at least a portion of the first exterior major surface to change the misorientation angle, wherein the single crystal body remains tilted along the first axis during the removal of material.

2. The method of claim 1, wherein the misorientation angle is greater than about 0.05° prior to removing material from the first initial exterior major surface.

3. The method of claim 1, wherein the misorientation angle is less than about 0.05° after removing material from the first exterior major surface.

4. The method of claim 1, wherein during removing material, the misorientation angle is changed by a delta (Δ) of not less than about 0.01°.

5. The method of claim 1, wherein the single crystal body comprises an aluminum oxide.

6. The method of claim 5, wherein the single crystal body is sapphire.

7. The method of claim 1, wherein characterizing further comprises comparing a selected crystallographic plane to a plane defined by the first initial exterior major surface and calculating a misorientation angle.

8. The method of claim 7, wherein the single crystal body comprises sapphire and the selected crystallographic plane has a substantially c-plane orientation comprising a tilt away from the c-plane at a tilt angle of not greater than about 5.0°.

9. The method of claim 1, wherein the single crystal body comprises a sheet, wherein a portion of the sheet has a substantially polygonal contour having opposing generally rectangular faces and side surfaces extending between and joining the opposing generally rectangular faces.

10. The method of claim 9, further comprising planarizing at least one side surface of the sheet prior to removing material from the first exterior major surface.

11. The method of claim 9, further comprising coring the sheet to remove a disk.

12. The method of claim 1, wherein the single crystal body comprises a disk having a substantially circular outer periphery.

13. The method of claim 1, wherein removing material comprises a grinding process.

14. A method for crystallographically re-orienting a single crystal body comprising:

characterizing the single crystal body by correlating a crystallographic orientation of the single crystal body to the orientation of an initial first exterior major surface of the body;

fixing the single crystal body in a position that is tilted along a first axis with respect to the initial first exterior major surface of the body; and removing material from said initial first exterior major surface to define a modified first exterior major surface that is non-parallel to the initial first exterior major surface to change the crystallographic orientation of the single crystal body, wherein the single crystal body remains tilted along the first axis during the removal of material.

15. The method of claim 14, wherein removing material comprises grinding with a bonded abrasive.

16. The method of claim 14, wherein fixing the single crystal body in a position further comprises rotating the single crystal body within a plane parallel to the plane of the first exterior major surface.

17. The method of claim 14, wherein fixing the single crystal body in a position further comprises tilting the single crystal body around a second axis, wherein the second axis is an axis orthogonal to the first axis and within the same plane as the first axis.

18. The method of claim 14, further comprising:

characterizing the single crystal body by correlating a crystallographic orientation of the single crystal body to the orientation of an initial second exterior major surface of the body;

fixing the single crystal body in a position that is tilted along a first axis with respect to the initial second exterior major surface of the body; and removing material from said initial second exterior major surface to define a modified exterior second exterior major surface that is non-parallel to the initial second exterior major surface to change the crystallographic orientation of the single crystal body.

19. An apparatus for changing the crystallographic orientation of a single crystal body comprising:

a stage configured to hold a single crystal body, the stage comprising interval tilt capabilities about at least one axis;

a x-ray gun directed at the stage and a x-ray detector positioned to detect x-rays diffracted from the single crystal body; and a grinding wheel configured to overlie and engage a single crystal body overlying the stage, the grinding wheel rotatable around an axis and translatable in a direction along the axis.

20. The apparatus of claim 19, wherein each interval of tilt is not greater than about 0.025 degrees.

* * * * *